United States Patent [19]

Stimens

[11] 4,322,605

[45] Mar. 30, 1982

[54] HEATING DEVICE FOR SKIN PACKAGING MACHINE

[75] Inventor: David R. Stimens, Plano, Tex.

[73] Assignee: Allied Automation, Inc., Dallas, Tex.

[21] Appl. No.: 159,616

[22] Filed: Jun. 16, 1980

[51] Int. Cl.[3] ..... H05B 3/06

[52] U.S. Cl. ..... 219/532; 174/138 J; 219/216; 219/388; 219/536; 219/548; 219/552; 338/287; 338/316; 338/318

[58] Field of Search ..... 219/216, 219, 357, 385, 219/386, 388, 532, 536, 537, 548, 542, 552, 553; 338/279, 283, 287, 293, 297, 315, 316, 318, 319, 320; 174/138 J; 53/30, 184

[56] References Cited

U.S. PATENT DOCUMENTS

| | | | |
|---|---|---|---|
| 2,912,661 | 11/1959 | Balestrini | 219/542 X |
| 3,019,324 | 1/1962 | Sohn | 338/316 X |
| 3,342,977 | 9/1967 | Anderson | 219/548 |
| 3,525,850 | 8/1970 | Hager, Jr. | 219/357 |
| 3,621,200 | 11/1971 | Watts, Jr. | 219/553 X |
| 3,632,981 | 1/1972 | Gasparaitis | 219/532 X |
| 3,673,387 | 6/1972 | Drugmand et al. | 219/532 |
| 3,935,376 | 1/1976 | Cooper et al. | 179/138 J |
| 3,944,784 | 3/1976 | Petterec et al. | 219/216 |
| 3,971,912 | 7/1976 | Krüger et al. | 219/216 |
| 4,220,847 | 9/1980 | Focke et al. | 219/388 |

*Primary Examiner*—Volodymyr Y. Mayewsky
*Attorney, Agent, or Firm*—Richards, Harris & Medlock

[57] ABSTRACT

A heating device (20) is provided that may be utilized in either a film packaging machine or a thermoforming machine. Heating device (20) includes a frame (32) that carries a plurality of eyelets (36) that are utilized to suspend an elongated ribbon heating element (34) so that apart from contact with the eyelets (36), the elongated ribbon heating element (34) does not contact any other portions of the heating device (20). This construction provides for very rapid heating and cooling response times resulting in an energy savings and a simplified packaging or thermoforming device, while providing accurate heat control.

7 Claims, 6 Drawing Figures

HEATING DEVICE FOR SKIN PACKAGING MACHINE

TECHNICAL FIELD

This invention relates to machines for thermoforming and skin packaging. More particularly, this invention relates to electric heaters having very fast response times and high efficiency.

BACKGROUND ART

In packaging operations, transparent thermoplastic films are frequently used which are relatively transparent to radiant energy. Accordingly, it is generally required to heat these films by convection. Typically, this is accomplished with a flow of hot air.

Modern skin-packaging machines are designed for use in many applications other than retail display packages. For example, they may be used in protecting products for shipment or storage. In such applications, the machines may be used intermittently and sporadically. Because of this sporadic or cyclic use, skin packaging and other machines normally use electricity as a source of energy for heat.

The same considerations apply to vacuum forming machines which utilize essentially the same equipment as skin packaging machines except that vacuum forming machines produce an article.

Skin packaging and vacuum forming devices generally require heating the heat-softenable film for a precise length of time prior to starting the machine cycle, and maintenance of that heat for a precise length of time during the cycle, after which the heat should be quickly and dramatically stopped. Continuously heated elements, if properly designed, provide a well-dispersed pattern of controlled heat. However, in order to quickly and accurately control the heating time before and during the machine cycle, the heat source must either be intermittently blocked with gates, doors or movable louvers, or more commonly the entire oven must be moved over and away from the film area. This requires additional mechanical devices and uses a large amount of floor space to accommodate the travel of the oven. This type of heat source is also very wasteful of energy since it requires a considerable amount of time to reach operating temperature, and it must be kept heated, even when no packages or formed pieces are being produced.

Quartz heaters have also been used in thermoforming and skin packaging devices. In this type of heater, a resistance wire or ribbon is wound around the outside, or the inside, of a quartz tube. When electric current is applied, the resistance element heats up fairly rapidly (about four seconds) causing the tube to emit heat rather quickly, and when the current is switched off, the heater cools down. There are several shortcomings in the quartz type heater approach. The quartz tubes are very fragile, causing great difficulties in shipping because of breakage. Even more important, the fragile nature of the product severely limits the length of a heater, making the method impractical for larger machines. Finally, with the heat generally concentrated in the tube areas there is a strong tendency for uneven heating of the plastic. Further, the quartz tube acts as a heat sink which requires time to cool when the electric current to the heater is terminated.

DISCLOSURE OF THE INVENTION

According to the present invention, a heating element for a skin packaging or vacuum forming machine is provided that includes a very thin, flat, high-resistance ribbon heating element that is suspended within a frame utilizing a series of eyelets or hooks that are attached to the frame so that the ribbon forms a network for providing an even heat output for the entire heated area. As used in the disclosure, all references to packaging devices are also to be taken as references to thermoforming machines unless otherwise indicated.

The heating element is preferably suspended within a metal frame by means of eyelets that are constructed of an insulating material, such as ceramic. This particular suspension design permits the heating element to be easily and quickly replaced and further allows the tension of the heating element to be adjusted, should this become necessary.

The ribbon heating element utilized in accordance with the present invention is suspended in a predetermined configuration for providing a substantial uniform source of heat over a desired area. The heating element is free from contact with the frame and the ribbon only contacts the eyelets that are attached to the frame for suspending the ribbon. Thus, a heating device for a skin packaging or thermoforming machine is provided that has very fast heating and cooling response times that eliminate the need for a shielded or movable heat source.

BRIEF DESCRIPTION OF THE DRAWINGS

The present invention can be more readily and completely understood by reference to the accompanying drawings in which.

DETAILED DESCRIPTION

In accordance with the present invention, an improved heater device is provided for use in standard packaging or thermoforming machines that provides rapid heating and cooling characteristics which permit the heater device of the present invention to be mounted in a stationary position relative to the heat packaging machine regardless of machine size. Further, because of the very fast heating and cooling response times, heating can be controlled more precisely and an energy savings can be realized over known prior art devices since electric current for the resistance heater need be supplied only a very short time prior to the time that heat is required.

One specific embodiment of the heater in accordance with the present invention is depicted in the FIGURES, together with a standard type of packaging machine.

Figure 1:
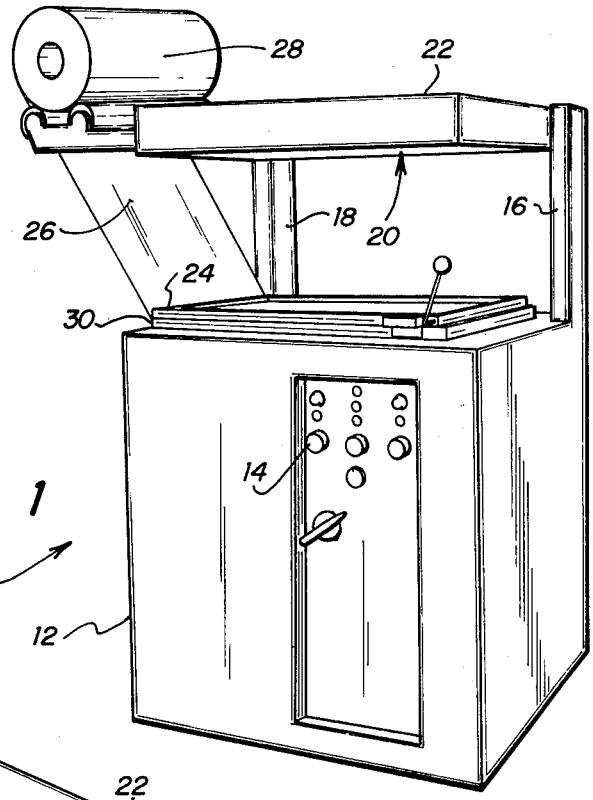
FIG. 1 depicts a typical packaging machine equipped with the heating device in accordance with the present invention.

Referring to the drawings in general and specifically to FIG. 1, a film packaging machine 10 is shown which is adapted to be supported on a floor. The machine shown in the drawings is, apart from the heater unit, of conventional design and construction. Accordingly, the packaging machine will be described only briefly. Film packaging machine 10 has a rectangular base 12 with a control panel 14 on a front surface of rectangular base 12. Two spaced, upright support columns 16 and 18 extend from two rear corners of rectangular base 12. A heating device 20 in accordance with the invention is contained within a hood 22. A film frame 24 is provided for movement to and away from hood 22. Film frame 24 is also utilized to guide and maintain tension on a section of packaging film 26. Packaging film 26 may be provided in a suitable roll 28. Below film frame 24, a perforated tray 30 is mounted on the top of rectangular base 12.

Figure 2:
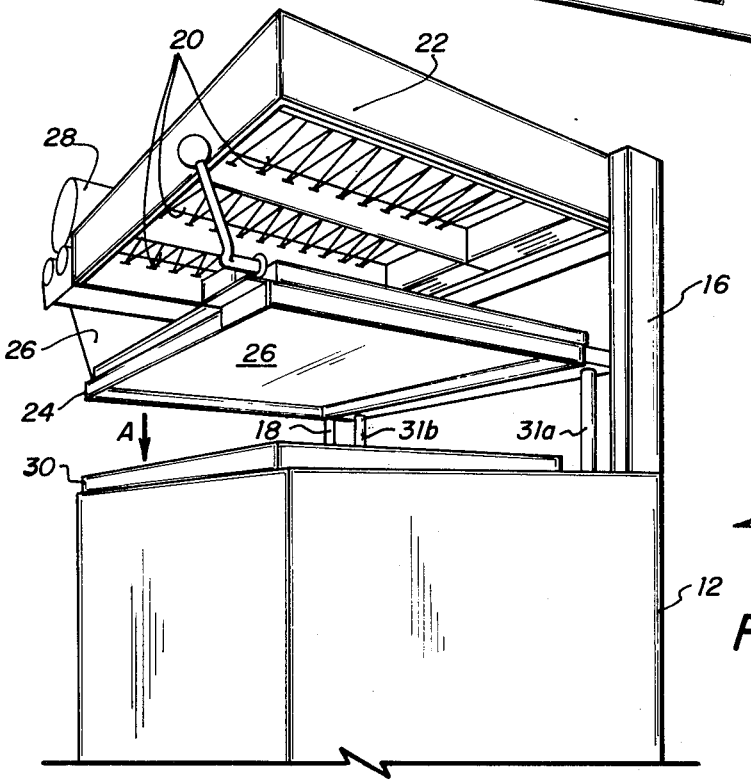
FIG. 2 shows the heating device of the present invention in place in the packaging machine of FIG. 1.

In use, a sheet of card stock or other material together with the product to be packaged is placed on perforated tray 30. A sheet of thermoplastic packaging film is secured to film frame 24. Film frame 24 is then raised towards hood 22 utilizing supports 31*a* and 31*b* while heating device 20 is energized. After the thermoplastic film is heated sufficiently, film frame 24 moves towards perforated tray 30 supporting the card stock and product. Apparatus is generally provided (not shown) to apply an air flow in the direction indicated by arrow A in FIG. 2 through perforated tray 30. The vacuum drawn through perforated tray 30 causes the thermoplastic film contained by film frame 24 to conform with the shape of the card stock and product, resulting in a packaged product. Generally, heating device 20 is deactivated after the vacuum through perforated tray 30 is activated.

Figure 3:
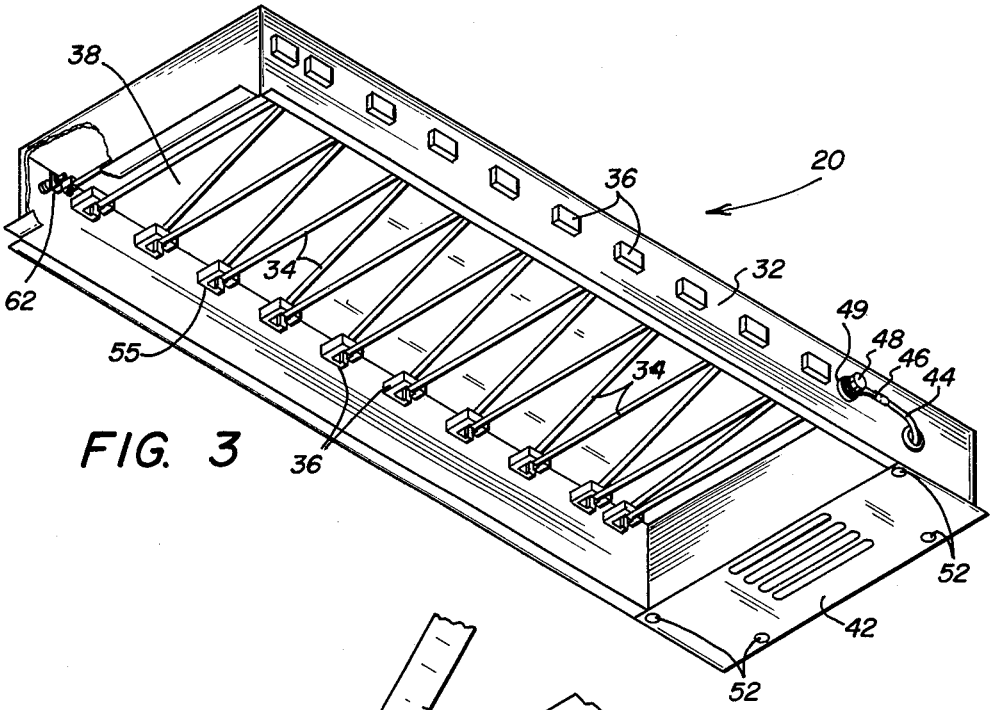
FIG. 3 is a perspective view of a heating device in accordance with the present invention.
Figure 4:
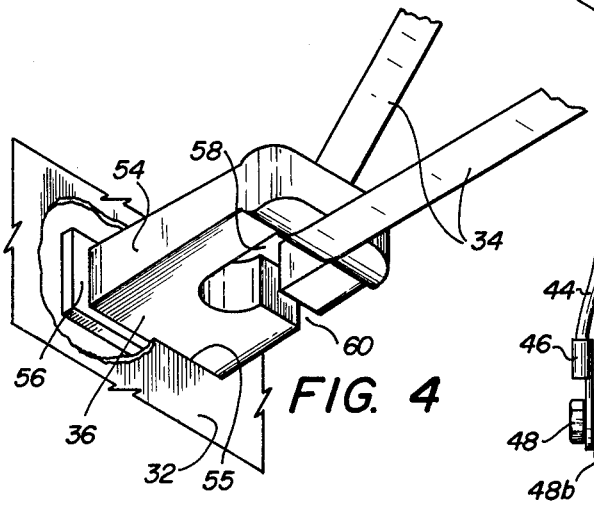
FIG. 4 is a perspective illustration of an eyelet used in the heating device of the present invention.
Figure 5:
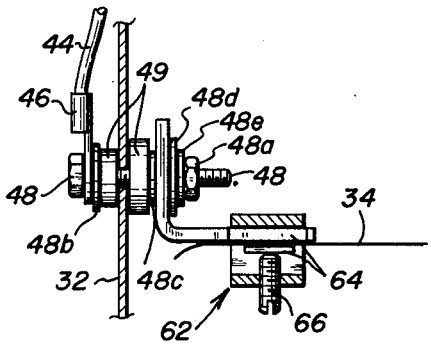
FIG. 5 is a perspective view of the tensioning device that forms part of the heating device shown in FIG. 3.
Figure 6:
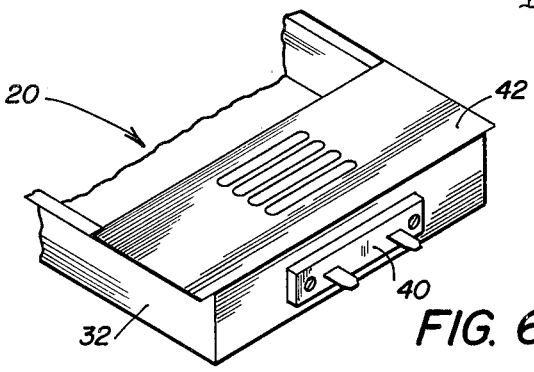
FIG. 6 is a perspective end view of the device shown in FIG. 3.

A preferred form of a heater device embodying the present invention is illustrated in FIG. 3, with various details of that device being illustrated in FIGS. 4–6. Heater device 20 includes a frame 32 and an elongated ribbon heating element 34. Frame 32 may be of any conventional shape and size. Elongated ribbon heating element 34 is suspended within frame 32 by a series of hooks or eyelets 36 within the sidewalls of frame 32 at predetermined locations. Thus, and as shown in FIG. 3, the ribbon heating element is suspended within frame 32 and contacts only the points where suspended by eyelets 36. Further, ribbon heating element 34 is oriented within frame 32 so that the surface of ribbon heating element 34 is essentially parallel to film frame 24 when utilized in film packaging machine 10. In this manner, the amount of heat directed by heating device 20 towards packaging film 26 is maximized.

While not a limitation of the present invention, the preferred type of ribbon heating element for use in accordance with the present invention is a nichrome ribbon that is about 0.0031 inches thick and about 0.125 inches wide. This type of ribbon is sold under the trade name "TOPHET C" by the Amex Specialty Metals Corporation of Orangeburg, N.C. Any suitable ribbon resistance heating element may be utilized in the heating unit of the present invention.

Thus, in accordance with the present invention there is no requirement of a blower to provide cooling for the heating units when the heater power source is terminated. As utilized in this specification, the term "rapidly reaching operating temperature" and "rapidly cooling down" means that an operating temperature of approximately 1,700°–1,800° F. will be attained in about 2 seconds or less and that a similar time will be required for the heating element to cool to a temperature at which the heat from the heater device has no effect on the packaging film for packaging or thermoforming purposes. Ribbon heating element 34 is preferably spaced at least about one inch away from the bottom portion of frame 32 indicated by reference numeral 38. This prevents any excessive heat build-up in frame 32. As shown in FIG. 3, eyelets 36 are arrayed so that when elongated ribbon heating element 34 is suspended by eyelets 36, zig-zag pattern results. Such a pattern is desirable because a very uniform heat pattern results therefrom. However, such a pattern is not a limitation on the invention, and any pattern may be utilized as long as no undesirable heat concentration or void will be produced.

Electrical energy is supplied to heating device 20 by means of any suitable connection. The voltage and amperage applied to the resistance ribbon heating element depends on the resistance of the ribbon and the temperature that is desired. In the embodiment of the invention illustrated in FIG. 3, a two-pronged plug 40 is provided so that heating device 20 can be easily plugged in to an electrical source. Two-pronged plug 40 is illustrated in FIG. 6 and is located at an end portion of frame 32. A cover 42 may be included on the end of frame 32 that contains two-pronged plug 40 to shield the electrical connections with two-pronged plug 40. FIG. 3 illustrates part of the electrical connection which includes a wire 44, a connector 46, a fastener 48 and an insulator 49. The design of these components is not a limitation upon this invention, the only requirement being that a suitable electrical connection be made. For example, as shown in FIG. 5, a nut 48(*a*) and bolt 48 arrangement, together with washers 48 *b, c, d* and *e* are utilized to provide an electrical connection with connector 46 and tightening device 62. A similar electrical connection is also made on the opposite side of frame 32 (not shown) so that ribbon heating element 34 is electrically connected by separate connections to each prong of two-pronged plug 40. Cover 42 may include several slots 50 to allow for dissipation of heat that may build up on the enclosed area of frame 32. Cover 42 is secured to frame 32 by any suitable means, such as a plurality of screws 52.

FIG. 4 illustrates one particular type of eyelet or hook that may be used to construct the heating unit of the present invention. As shown in FIG. 4, eyelet 36 includes a fastener portion 54 and a shoulder portion 56. Fastener portion 54 is utilized to suspend ribbon heating element 34 within frame 32. In the illustrated embodiment, a series of rectangular holes 55 are cut in the sides of frame 32 where it is desired to locate eyelets 36. Each hole 55 in frame 32 is dimensioned to allow insertion therein of fastener portion 54 of eyelet 36. Shoulder portion 56 is larger than hole 55 and abuts the outer wall of frame 32 restraining movement of eyelet 36. Tension on ribbon heating element 34 prevents movement of eyelets 36 from holes 55 located in frame 32. Eyelet 36 includes an eye 58 and may optionally include a slot 60 to facilitate insertion of ribbon heating element 34 into eye 58. Naturally, eye 58 and slot 60 should preferably be dimensioned to permit insertion of ribbon heating element 34 without any crimping or folding of ribbon heating element 34.

Also in accordance with the present invention, a tensioning device for ribbon heating element 34 is provided. This is important for holding eyelets 36 in place and also should ribbon heating element 34 stretch or sag after repeated use, the tension may be easily and quickly adjusted. As shown in FIG. 3, and in greater detail in FIG. 5, a tensioning device 62 is provided. Tensioning device 62 is a clamp that includes jaw 64 and tightening member 66. Tensioning device 62 is electrically connected to connector 46. Ribbon heating element 34 is inserted between and through the members of jaw 64 and may then be fastened within tensioning clamp 62 merely by advancing tightening member 66. It is necessary that tensioning device 62 form an electrical connection between ribbon heating element 34 and connector 46. Thus, a simple and easy method is provided for adjusting and maintaining the proper tension on ribbon heating element 34.

Although the invention has been described with respect to preferred embodiments, it is understood that numerous changes, modifications and rearrangements may be made without departing from the scope of the appended claims.

I claim:

1. In a packaging machine for applying a heat softenable film to a product utilizing an electric heat source, a heater unit comprising:

(a) a frame carrying a plurality of suspension points and having a covering portion spaced above said suspension points; and (b) an elongated replaceable ribbon heating element suspended from said suspension points within said frame in a predetermined configuration for providing a substantially uniform source of heat over a desired area for heating air surrounding said ribbon element to thereby heat the film, said elongated ribbon being free from contact with said frame except at a plurality of suspension points to allow said heater to reach operating temperature after electric current is supplied to said ribbon in not more than about two seconds yet permit said heater unit to cool to a temperature at which the heater has no effect on the heat softenable film for thermoforming purposes within a period of not more than about two seconds after the electric current is terminated thereby allowing said heater unit to remain stationary relative to the packaging machine during operation.

2. The heater unit as recited in claim 1 wherein said elongated ribbon is constructed of nichrome having a thickness of about 0.0031 inches and a width of about 0.125 inches.

3. The heater as recited in claim 1 wherein the average heat density provided for heating the film is about 20 watts per square inch.

4. The heater as recited in claim 1 wherein said predetermined configuration is symmetrical about the length and width of said heater unit for providing a uniform heat gradient.

5. The heater as recited in claim 1 wherein tension of said ribbon is adjustable.

6. The heater as recited in claim 1 wherein said ribbon is suspended by means of eyelets attached to said frame, said ribbon passing through said eyelets.

7. The heater as recited in claim 1 wherein said eyelets are constructed of an insulator material.

* * * * *